US005600337A

United States Patent [19]

Cassel

[11] Patent Number: 5,600,337

[45] Date of Patent: Feb. 4, 1997

[54] Y-ANTENNA

[75] Inventor: Jan Cassel, Djursholm, Sweden

[73] Assignee: Moteco AB, Ruda, Sweden

[21] Appl. No.: 428,070

[22] PCT Filed: Nov. 15, 1993

[86] PCT No.: PCT/SE93/00969

§ 371 Date: May 23, 1995

§ 102(e) Date: May 23, 1995

[87] PCT Pub. No.: WO94/13030

PCT Pub. Date: Jun. 9, 1994

[30] Foreign Application Priority Data

Nov. 20, 1992 [SE] Sweden ..... 9203529

[51] Int. Cl.[6] ..... H01Q 13/10

[52] U.S. Cl. ..... 343/770; 343/767; 343/846

[58] Field of Search ..... 343/767, 770, 343/830, 846; H01Q 13/10, 13/18

[56] References Cited

U.S. PATENT DOCUMENTS

| | | | |
|---|---|---|---|
| 2,570,824 | 10/1951 | Lindenblad | 343/767 |
| 2,996,715 | 8/1961 | Rumsey et al. | 343/767 |
| 4,843,403 | 6/1989 | Lalezari et al. | 343/767 |

FOREIGN PATENT DOCUMENTS 0301216 2/1989 European Pat. Off. .

*Primary Examiner*—Michael C. Wimer

*Attorney, Agent, or Firm*—Beveridge, DeGrandi, Weilacher & Young, L.L.P.

[57] ABSTRACT

A Y-Antenna which includes an elongate Y-shaped metal portion and a bottom plate of metal which is mounted beneath and substantially at right angles to the vertical shank of the Y-shaped metal portion and is galvanically connected to this shank. The Y-shaped metal structure includes two preferably parallel notches, quarter wave resonant on different frequencies and preferably open at one short end and which are electromagnetically coupled to one another. The two parallel notches are disposed in the V-shaped shanks of the Y and, in one preferred embodiment, have a common side which consists of the upper edge of the vertical portion of the Y. In one preferred embodiment, only one of the notches is directly fed with energy. The antenna gain and the bandwidth of the antenna can be increased with the aid of an extra metal screen in the form of a shank which is galvanically connected to the short-circuited short end of the directly fed V-shank, whereafter the extra shank is bent so that it covers approximately 70% of the upwardly directed longitudinal aperture of the V-shanks. A further increase of the bandwidth can be obtained in that upper edges of the shanks are provided with rectangular sheet flarings.

13 Claims, 3 Drawing Sheets

Y-ANTENNA

BACKGROUND OF THE INVENTION

The present invention relates to a low, open notch antenna, designated a Y-antenna, preferably intended as a mobile telephone antenna for motor vehicles, or alternatively for portable pocket telephones or personal pagers. The antenna comprises a Y-shaped sheet structure with two open notches quarter wave resonant, at different frequencies, electromagnetically coupled to one another and fed preferably by means of one feed unit at a common feed point. The antenna further includes a rectangular base plate of metal symmetrically mounted beneath and at right angles to the vertical shank of the Y, and galvanically connected thereto.

In certain cases when the antenna is placed on a large sheet metal area as is the case in private cars, the base plate can be secured to the sheet metal of the car by means of a retentive double-adhesive tape via which the antenna will moreover be capacitatively coupled to the subjacent sheet metal of the vehicle. In other cases when the antenna is mounted on a portable table pocket telephone or a personal pager, the base plate is designed so that it is possible, by filter effect, to obtain if necessary a relatively large coupling impedance between the antenna and the apparatus chassis.

Antennas for motor vehicles normally consist of a quarter wave long monopole antenna or a colinear Franklin antenna normally approx. three quarter waves high and, as far as portable telephones are concerned, the quarter wave or half wave long antennae are the most generally prevalent. Antennas with an open slot, so-called notch antennas (FIG. 1) are known in the art and described by Cary and Johnson.

However, it should be observed that, for example, a notch antenna (FIG. 1) described by Cary and Johnson does not give an omnidirectional radiation pattern, but a pattern of the cardioid type in the yz plane, which signifies maximum radiation in the direction of the positive x axis and zero radiation in the opposite direction. In this case, the notch antenna consists of a notch in a large sheet metal, as is apparent from FIG. 1.

If the sheet is cut considerably so that the remaining sheet around the notch, for example the distance between notch and edge, is of the order of magnitude of between 3 and 4 hundredths of a wavelength of that frequency where the open notch has its quarter wave resonance, and if this considerably cut notch sheet is placed at right angles above, and ideally in contact with, an earth plane sheet, there will be obtained an as good as omnidirectional antenna or, in other words, there will be obtained that antenna which is shown in FIG. 2 and whose radiation properties also substantially correspond to a quarter wave high monopole antenna when this, in a corresponding manner, is placed above an earth plane. The height of the notch antenna can be limited to less than a tenth of a wavelength (0.10 lambda) which is to be compared with the height of a monopole antenna which, at resonance, is just beneath a quarter wavelength (0.25 lambda).

The above described version of the notch antenna, which corresponds to the antenna embodiment according to FIG. 2, is known in the art. For many applications where an antenna of slight extent in the vertical direction and good omnidirectional radiation properties is desired, the above-described version of the notch antenna offers a satisfactory solution to the antenna problem as far as these properties are concerned, but it is a solution which, in many cases, can nevertheless not come into question because of the unsatisfactory band width properties of the antenna design and construction.

SUMMARY OF THE INVENTION

The present invention has for its object to realise an antenna possessing superior omnidirectional radiation properties which, in addition to being to slight extent in the vertical direction, also offers a greater banwidth capability than the prior art notch antenna described above. The present invention realises a mechanically simple and low omnidirectionally radiating and vertically polarized antenna of substantially the same omnidirectional radiation properties and polarization as well as length and vertical dimensions as a prior art embodiment of the notch antenna (FIG. 2), in addition to which the antenna according to the present invention, apart from being low and short, displays a considerably improved band width which entails 7 to 8% or more, which greatly exceeds the band width which the corresponding prior art antenna shown in FIG. 2 can offer. This situation is based int. al. on the fact that the antenna according to the present invention includes two parallel notches of different lengths.

The above and other objects have been attained according to the present invention by means of a low Y-shaped metal structure whose height can be restricted to less than a tenth of a wavelength of the central frequency in the working range of the antenna, and in which the Y-shaped structure is designed in such a manner that it includes two quarter wave resonant, preferably parallel notches which are open at one short end and are electromagnetically coupled to one another.

According to one preferred embodiment, the two notches have a common side which consists of the upper edge of the vertical portion 14 of the Y. The open parallel notches 24 and 26 are each disposed in their V-shaped shank 10 and 12 of the Y, the angle between the V-shaped shanks being of the order of magnitude of 2°×30°–60° or 60°–120 ° in total . In the preferred embodiment, only one notch—preferably the low frequency i.e. the longer notch—is fed. This entails that the one notch is directly fed and the other is fed by mutual electromagnetic field connection so that the field fed notch enters into function when the frequency of the transferred field energy approches the resonance frequency of the notch, at the same time as it then distances itself from the resonance frequency of the directly led notch. As Ear as the electromechanical design is concerned, it should be observed that the Y-shaped metal structure is galvanically connected to a base plate 16 made of metal which, for example, can constitute a part of an earth plane or function as a coupling element to an adjacent earth plane to, in other words, constitute a part of a counterweight to the Y-shaped antenna structure.

The base plate is designed and coupled to the antenna carrier on which the antenna is to be placed in such a manner that the radiated energy on transmission and thereby maximum sensitivity on receiving are obtained and this, as far as possible, in a plane which is imagined as extending at right angles out from the vertical Y-shank 14, and that the outgoing radiation and sensitivity, respectively are equal or have slight variations in each bearing direction in this plane.

By employing a slightly more complex design of the invention, the antenna gain in the above-mentioned plane, like the band width of the antenna can be increased by a few percent. This is achieved by reducing the radiation out from the V-aperture of the Y-structure, which is realised with the aid of an extra metal screen 22 which is galvanically connected to the shortcircuited short end of the directly fed V-shank, whereafter the extra shank extends just outside the plane through the longitudinal aperture of the V-shank where it is bent so that this covers approx. 70% thereof. The edges of this extra shank follow along the longitudinal sides of the V-shanks to more than half of their length and at a distance which preferably is less than one hundredth of a wavelength within the frequency band of the antenna.

Further increase of the band width to above 10% i.e. 10–11% or more is achieved by introducing edge disruptions in the upper edges of shanks 10 and 12 that extend off from upper horizontal or base line edge portions of the upper edges of the shanks 10 and 12. In one preferred embodiment, these disruptions are applied as a toothing of these edges preferably in the form of rectangular flarings 27 and 28 of the shank plates 10 and 12, the free corners of the rectangles having been cut at 45°, FIG. 8. As a result of this edge toothing, the Q values of the two notch resonances are reduced and, thereby, each notch gives a greater band width. Influence of the resonances of the notch resonances is determined by the height, length and position of the sheet teeth along the upper edges of the shanks 10 and 12. The sheet teeth are preferably placed so that they are in the middle of the upper edges of the shanks 10 and 12. The length of the teeth is, in one preferred embodiment, approx. ⅛th of a wavelength at the opposing notch resonance frequency and their height corresponds to one to two hundredths of a wavelength of the central frequency in the working range of the antenna.

The dimensions of the teeth are trimmed so that the both notches' broadened frequency bands overlap one another. The feed impedance of the antenna can, in such instance, be well adapted to the impedance of the feed cable without large variations over the entire working frequency range of the antenna and this entails also that only small variations in the radiation properties of the antenna can be obtained over the same frequency band.

BRIEF DESCRIPTION OF THE DRAWINGS

The further objects of the present invention and the advantages afforded by the invention will be more readily understood by reference to the following description and the accompanying drawings which show one preferred embodiment of the Y-antenna according to the invention.

DETAILED DESCRIPTION OF THE PREFERRED EMBODIMENTS

Figure 1:
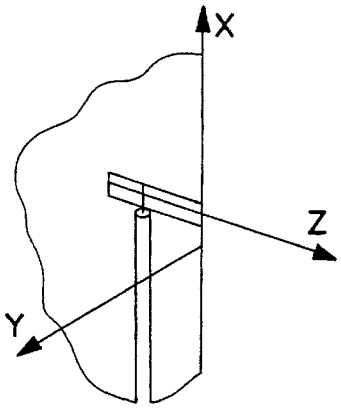
FIG. 1 PRIOR ART
FIG. 1 shows a prior art notch antenna.
Figure 2:
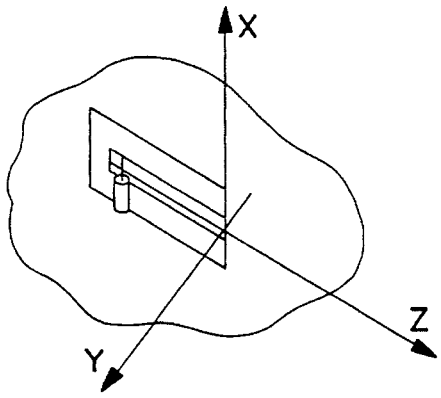
FIG. 2 PRIOR ART
FIG. 2 shows a particular embodiment of the prior art notch antenna.
Figure 3A:
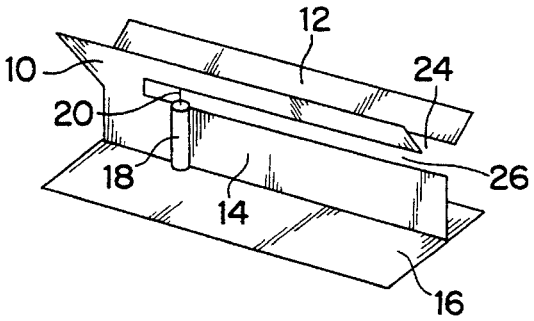
FIG. 3 (*a–c*) show by way of example one embodiment of the present invention.
Figure 3B:
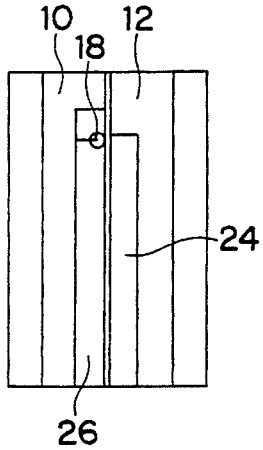
Figure 3C:
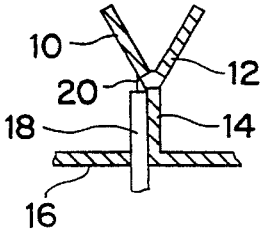

The Y-antenna according to the present invention comprises a Y-shaped sheet structure 14 with two open notches 24 and 26 quarter wave resonant at different frequencies, each disposed in the V-shaped shanks and 10 and 12, respectively, of the Y, where the angle between these shanks is preferably 60° (FIG. 3 *a–c*). In the illustrated embodiment of the Y-antenna, only the longer, lower frequency notch 26 is supplied with energy, which, thus, is thereby directly fed while the second notch 24 is fed by mutual electromagnetic field connection between the notches. The feed unit consists, in the preferred embodiment, of a so-called semi-rigid coaxial cable 18. As shown in FIG. 3(*b*), the notch 26 is directly fed by feed unit 18 attached to upper member 10 and the feed unit is positioned, with respect to the longitudinal direction of the notches, at a location commensurate with the closed end of the notch being fed electromagnetically.

Figure 4A:
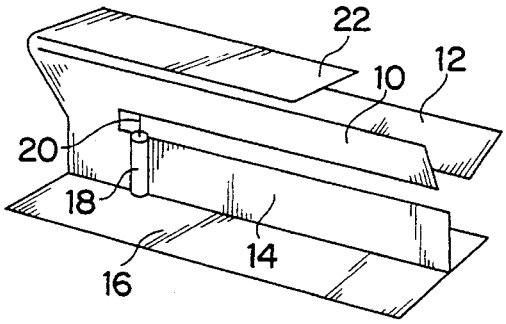
FIG. 4 (*a–b*) show one example of a further embodiment of the present invention.
Figure 4B:
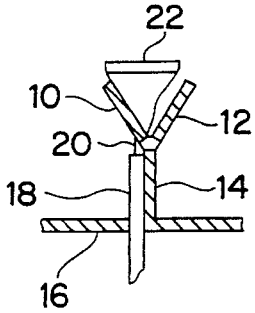
Figure 5A:
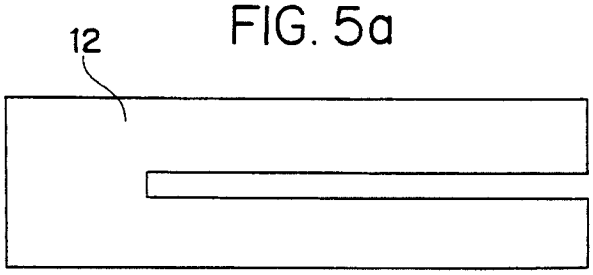
FIG. 5 (*a–c*) and FIG.7 (*a–c*) show examples of component parts included in the antenna of the present.
Figure 5B:
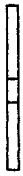
Figure 5C:
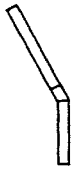
Figure 6A:
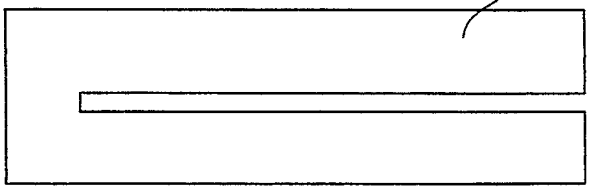
Figure 6B:
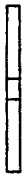
Figure 6C:
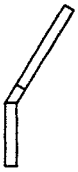
Figure 7B:
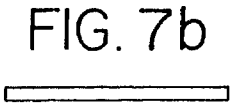
Figure 7A:
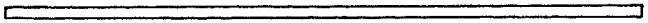
Figure 8:
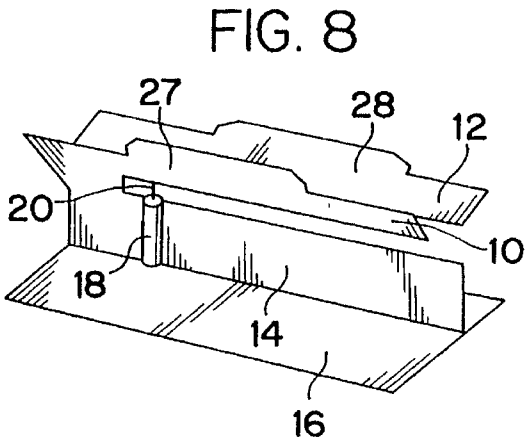
FIG. 8 shows a modified embodiment of the invented antenna.
Figure 7C:
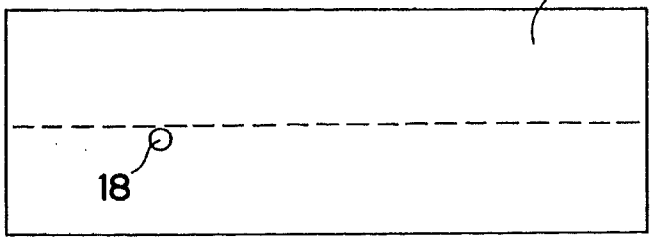
Figure 10:
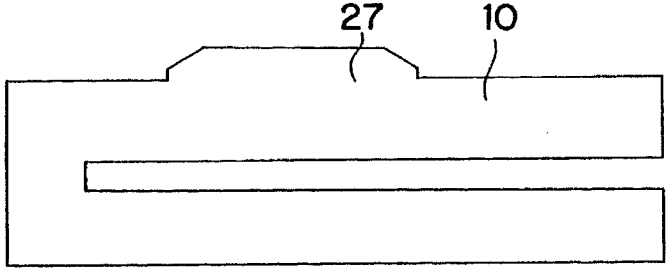
FIG. 9 and FIG. 10 show examples of component parts included in the antenna of the present invention.
Figure 9:
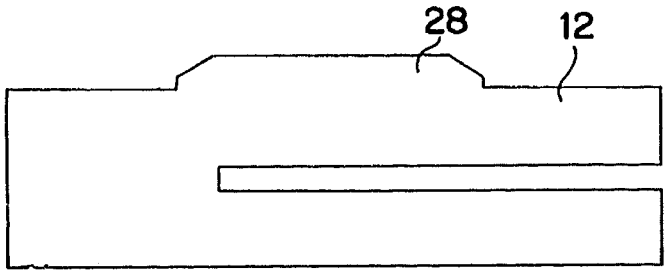

A more complex embodiment of the present invention includes an extra metal shank 22 which is shown in FIG. 4*a* and/or alternatively rectangular flarings 27,28 along the upper edges of the shanks 10 and 12, as shown in FIG. 8.

Since the notches are of different lengths and thereby different resonance frequencies, they can function each in the two adjacent frequency ranges. The directly fed notch functions in the frequency range of the second notch as a link in a transmission chain on transmission of energy to the second notch.

If the intention is that the Y-antenna is to encompass a wide, unbroken frequency band, the notch lengths and the position of the feed point 20 are trimmed until the adjacent frequency ranges obtain a well adapted overlap region which entails good impedance adaptation and good radiation properties within the total frequency band.

The angle between the two shanks 10 and 12 of the V, like the notch width, belong to those parameters which influence the coupling between the notches and should therefore be included in a fine tuning of the Y-antenna. The antenna is suitably mounted on a planar metal plate 16. In a carrier wave frequency of approx. 890 MHz, the antenna can suitably have the following data:

| | |
|---|---|
| Antenna length | 85.0 mm |
| Antenna height | 23.0 mm |
| Notch length (26) | 75.0 mm |
| Notch length (24) | 85.0 mm |
| Notch height (26) | 2.7 mm |
| Notch height (24) | 2.7 mm |
| Shank height (10) | 25.0 mm |
| Shank length (10) | 85.0 mm |
| Shank height (12) | 25.0 mm |
| Shank length (12) | 85.0 mm |
| Shank width (10) | 12.3 mm |
| Shank width (12) | 12.3 mm |
| Base plate (16) length | 85.0 mm |
| Base plate (16) width | 30.0 mm |
| Extra shank total length | 75.0 mm |
| Shank edge tooth length (27) | 32.0 mm |
| Shank edge tooth height (27) | 5.0 mm |
| Shank edge tooth length (28) | 40.0 mm |
| Shank edge tooth height (28) | 5.0 mm |

Different alterations and modifications of the invention are possible without these falling outside the scope of the present invention such as that which is defined in the Claims. For example, the dimensions of the antenna can De changed so that it suits other frequencies, eg. frequencies around 450 MHz or 1700 MHz.

I claim:

1. A Y-antenna, comprising: an elongate metal structure having a Y-shaped cross-sectional shape, said Y-shaped structure having a first upper member and a second upper member forming an angle with one another, and said upper members each having an upper edge and a lower edge, said Y-shaped structure further including a lower, substantially vertical member having an upper edge and a lower edge, and the lower edges of said two upper members being connected to the upper edge of the lower member;

a bottom metal plate galvanically connected at substantially right angles to the lower member at the lower edge thereof;

and said Y-shaped structure including two notches extending substantially parallel and provided one in each of said upper members, the notches being quarter wave resonant at different frequencies, a first one of the notches corresponding to a first frequency and a second of said notches corresponding to a higher frequency than said first frequency, said notches being open at a first end and closed at an opposite end, and said notches having one side in common which common side is defined by the upper edge of the lower member.

2. The antenna as claimed in claim 1, wherein the first one of the notches is fed directly by a feed unit for the antenna which is coupled to the first upper member while the second notch is fed by electromagnetic coupling.

3. The antenna as claimed in claim 2, wherein said notches are of different longitudinal lengths and the feed unit is positioned, with respect to the longitudinal length of the notches, at a location commensurate with the closed end of the notch being fed electromagnetically.

4. The antenna as claimed in claim 1, wherein the angle between the two upper members is 60° to 120°.

5. The antenna as claimed in claim 1, wherein the angle is approximately 60°.

6. The antenna as claimed in claim 1, wherein said notches are of different longitudinal lengths so as to have the second of the notches correspond with a higher frequency than the first of the notches.

7. The antenna as claimed in claim 1, wherein said Y-shaped metal structure has a height that is restricted to less than a tenth of a wavelength of a central frequency of a working range of said antenna.

8. The antenna as claimed in claim 1, wherein a fourth metal member is galvanically connected to the first upper member at an end edge thereof adjacent the closed end of the first one of the notches, said fourth member extending upwardly just outside a plane defined by end edges of both the first and second upper members adjacent the closed ends of the first and second notches to a level slightly above the upper edges of the first and second upper members where said fourth metal member has a bent section which leads into an overhang section with the overhang section extending longitudinally along and vertically above said upper edges to cover an upper portion of said Y-shaped structure.

9. The antenna as claimed in claim 8, wherein said overhang section extends for more than one-half of the longitudinal length of said upper members and covers 70% of an open area defined between the upper edges of the first and second upper members.

10. A Y-antenna, comprising:

an elongate metal structure having a Y-shaped cross-sectional shape, said Y-shaped structure having one first upper member and one second upper member forming an angle with one another, and both upper members each having one upper edge and a lower edge, said Y-shaped structure further including a lower, substantially vertical member with one upper edge and one lower edge, the lower edges of the two upper members being connected to the upper edge of the lower member;

a bottom metal plate galvanically connected at substantially a right angle to the lower member at the lower edge thereof;

two substantially parallel notches provided one in each of the upper members, the notches being quarter wave resonant at different frequencies, a first one of the notches corresponding to a first frequency and a second one of the notches corresponding to a second frequency higher than the first, said notches each being open at a first one of their ends and closed at an opposite end, said notches having one side in common with said common side being defined by the upper edge of the lower member, and said first and second upper members having edge disruptions extending off of a base line portion of the upper edges of the first and second upper members.

11. The antenna as claimed in claim 10 wherein said edge disruptions include substantially rectangular shaped flarings which are intermediately positioned along the upper edge of said upper members.

12. The antenna as claimed in claim 11 wherein said substantially rectangular shaped flarings include upper corner cut portions.

13. A Y-antenna, comprising:

an elongate metal structure having a Y-shaped cross-sectional shape, said Y-shaped structure having one first upper member and one second upper member forming an angle with one another, and both upper members each having one upper edge and a lower edge, said Y-shaped structure further having a lower, substantially vertical member with one upper edge and one lower edge, the lower edges of the two upper members being connected to the upper edge of the lower member;

two substantially parallel notches provided one in each of the upper members, the notches being quarter wave resonant at different frequencies, a first one of the notches corresponding to a lower frequency than a second one of the notches, each of said notches each being open at a first one of their ends and closed at an opposite one of their ends, said notches having one side in common with said common side being defined by the upper edge of the lower member, and said first upper member is directly driven by a feed unit for the antenna which is coupled to said first upper member while the second notch is fed by electromagnetic coupling.

* * * * *